United States Patent [19]

Palac

[11] 4,066,310

[45] Jan. 3, 1978

[54] METHOD FOR INTRODUCING A HIGH VOLTAGE CONDUCTOR INTO A TELEVISION CATHODE RAY TUBE

[75] Inventor: Kazimir Palac, Carpentersville, Ill.

[73] Assignee: Zenith Radio Corporation, Glenview, Ill.

[21] Appl. No.: 756,205

[22] Filed: Jan. 3, 1977

[51] Int. Cl.[2] ..... H01J 9/18

[52] U.S. Cl. ..... 316/19; 316/18

[58] Field of Search ..... 316/17, 18, 19, 24, 316/26; 29/25.15, 25.16

[56] References Cited

U.S. PATENT DOCUMENTS 3,552,818 1/1971 Benda ..... 316/11

*Primary Examiner*—Richard B. Lazarus

*Attorney, Agent, or Firm*—Ralph Clarke

[57] ABSTRACT

A method of introducing a high voltage electrical conductor through the neck of a television cathode ray tube comprising the providing of a gun-base assembly comprising a hollow glass stub tubulation on one end of which is an annular glass base carrying an electron gun assembly. On the distal end of the stub tubulation is temporarily secured a hollow holder. An electrical conductor is provided which passes through the stub tubulation. The gun-base assembly is inserted into the neck and hermetically bonded to the neck. The cathode ray tube is evacuated through the stub tubulation and the temporary holder. Heat is applied circumferentially to the stub tubulation to soften and pinch off the tubulation, sealing the evacuated tube against re-entry of air. The temporary holder is detached from the stub tubulation to form a cup in the end of the tubulation for receiving an electrical connector.

4 Claims, 5 Drawing Figures

METHOD FOR INTRODUCING A HIGH VOLTAGE CONDUCTOR INTO A TELEVISION CATHODE RAY TUBE

CROSS REFERENCE TO RELATED APPLICATION

This application is related to but in no way dependent upon the copending application of common ownership herewith, Ser. No. 756,204 filed Jan. 3, 1977.

BACKGROUND OF THE INVENTION

This disclosure concerns television picture tubes of the type requiring one or more high voltages for operation, and a means for introducing such a voltage into the picture tube.

Electron guns used in television picture tubes usually require a high voltage for operation. In present-day, high-brightness color picture tubes, this "ultor anode" voltage may be 30 kilovolts or higher. In standard practice, this voltage is introduced into the picture tube envelope through an anode button that extends through the tube funnel. An electrical path within the tube conducts the high voltage to at least one high voltage anode electrode of the electron gun.

Recently developed electron guns, such as described in U.S. Pat. No. 3,895,253, assigned to the assignee of this invention, may require a secondary high voltage. This secondary high voltage may be in the range of, for example, 11 to 18 kilovolts.

Problems may arise in introducing a secondary voltage of this magnitude into the tube envelope. A button similar to the anode button in the funnel, but extending through the neck, can be used; however, this appreciably increases the cost of manufacture. Another way of introducing a secondary voltage is by conduction through a lead-in pin located in the base of the tube. The use of this method, however, may result in arcing problems because of the close propinquity of the pins in present-day tubes.

The problem of arcing in the pin area is further aggravated by the need for high-voltage conditioning, or "spot-knocking" of electron guns. This is a process whereby a very high direct-current voltage, usually in the range of thirty to fifty kilovolts is conducted through the afore-described high-voltage pin. This high voltage may contain in addition an increment of pulsed radio frequency voltage. These potentials are applied to deliberately induce benign arcing between the electrodes, as such arcing removes or "knocks" minute electrode protrusions or unwanted particles ("spots"), which could act as potential arc paths if allowed to remain on the electrodes. To prevent arcing between the pins during this "spot-knocking" procedure, the base of the tube under test is usually immersed in an electrically inert liquid of high dielectric strength.

A means for arc-prevention between lead-in pins is described and claimed in referent copending application Ser. No. 756,204. Arc-prevention is achieved during conditioning and during normal operation of the tube by the provision of an extended, yet axially compact, arc path length between the relatively high-voltage pins and between the high-voltage pins and adjacent relatively low-voltage pins.

Sokolov in U.S. Pat. No. 2,667,528 addressed the problem of introducing a high-voltage lead into the evacuated envelope of a small, radio-type electron tube. The disclosed tube comprises a structure wherein a high voltage lead is brought out of the tube envelope through an exhaust tubulation, the tip and the tube key. Provision is made for connecting circuit wiring to the lead by means of a cap and socket connector. The technique is not known to be utilized in television picture tubes and indeed is not believed to be susceptible to use in such tubes.

A prior art apparatus for evacuating a television picture tube is shown by FIG. 1. A base section 10 of a television cathode ray tube (not shown) in preparation for evacuation will be readily recognized by those skilled in the art. A plurality of lead-in pins 12 are represented schematically. In the process of evacuation, an exhaust tubulation 14 is inserted into the vacuum port 16 of vacuum pump 18, shown in highly schematic form. A pliable seal 20, which may be in the form of an O-ring, provides an air-tight connection between tubulation 14 and vacuum port 16.

Vacuum pump 18 withdraws the air from the interior of the cathode ray tube envelope, as indicated by arrow 22. When the desired vacuum has been obtained; that is, a vacuum of about $10^{-6}$ torr, tip-off oven 24, indicated schematically, is positioned as shown. Incorporated within tip-off oven 24 is a resistive element energized by an electric current. When energized, the resistive element heats tip-off oven 24 and softens the glass of tubulation 14. The vacuum within the cathode ray tube envelope causes the softened glass to be pulled inwardly; the subsequent shape is shown by 26, and is commonly termed a "pinch-off." The tubulation 14 is conventionally then cut off at the point indicated by arrows 28 by circumferentially scoring the tubulation and flexing it, causing it to break off.

Other Prior Art

U.S. Patents 3,852,699: Kimura et al
3,716,819: Borth
3,603,914: Manetti et al
3,377,612: Klier et al
3,278,886: Blumenberg et al
3,240,980: Schuster
2,509,709: van der Spek
1,583,463: Housekeeper
1,536,855: Housekeeper

OBJECTS OF THE INVENTION

It is a general object of this invention to provide an apparatus and method for introducing a high voltage conductor into the evacuated envelope of a television picture tube.

It is another object of this invention to provide such an apparatus that is highly resistant to electrical arcing both within the evacuated envelope of the tube and externally in the area of the tube base.

It is yet another object to provide a method of manufacture of such an apparatus which is easily implementable and which will yield cost savings.

BRIEF DESCRIPTION OF THE DRAWINGS

The features of the present invention which are believed to be novel are set forth with particularity in the appended claims. The invention, together with objects and advantages thereof, may best be understood, however, by reference to the following description taken in conjunction with the accompanying drawings, in the several figures of which like reference numerals identify like elements and in which:

DESCRIPTION OF THE PREFERRED EMBODIMENT

There will now be described with reference to the appended drawings my apparatus and method for introducing a high voltage conductor into a television cathode ray tube.

Figure 1:
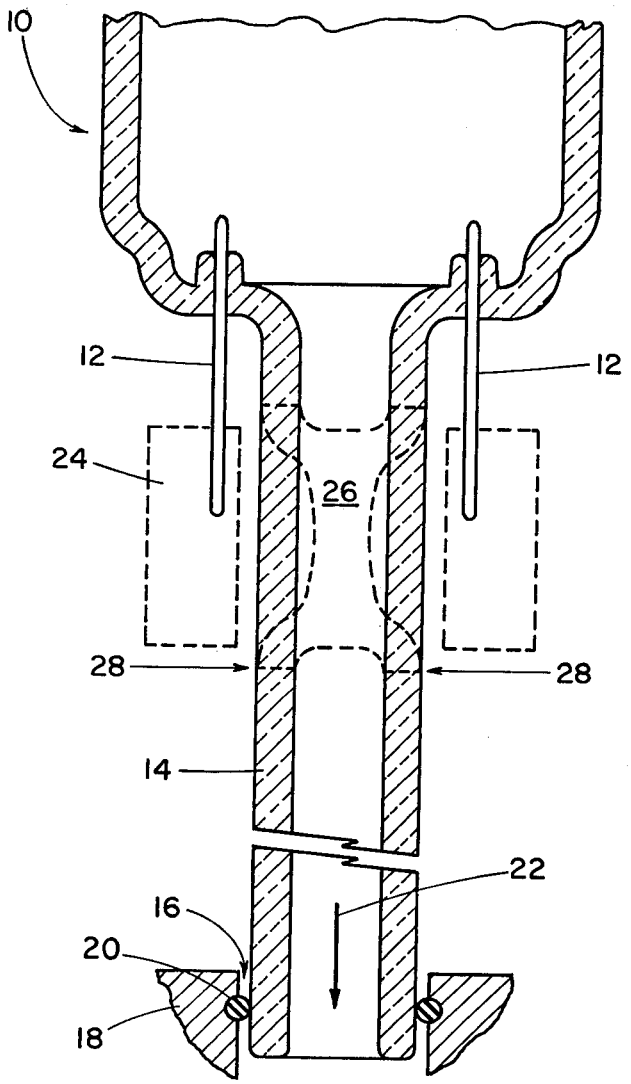
Fig. 1 PRIOR ART
FIG. 1 is a sectional fragmentary side view of the base area of a television cathode ray tube showing standard means for sealing the evacuated tube against reentry of air.
Figure 2:
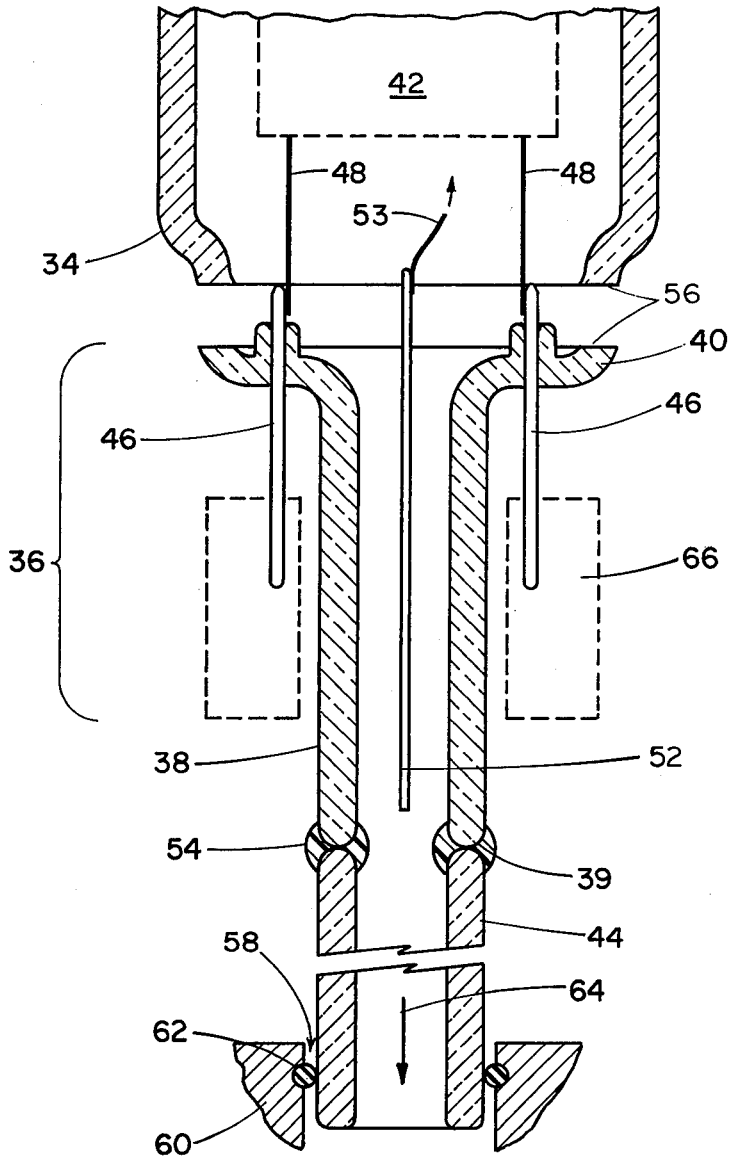
FIG. 2 is a sectional fragmentary side view of a cathode ray tube showing a part of my novel conductor installation method and structures according to this invention.
Figure 3:
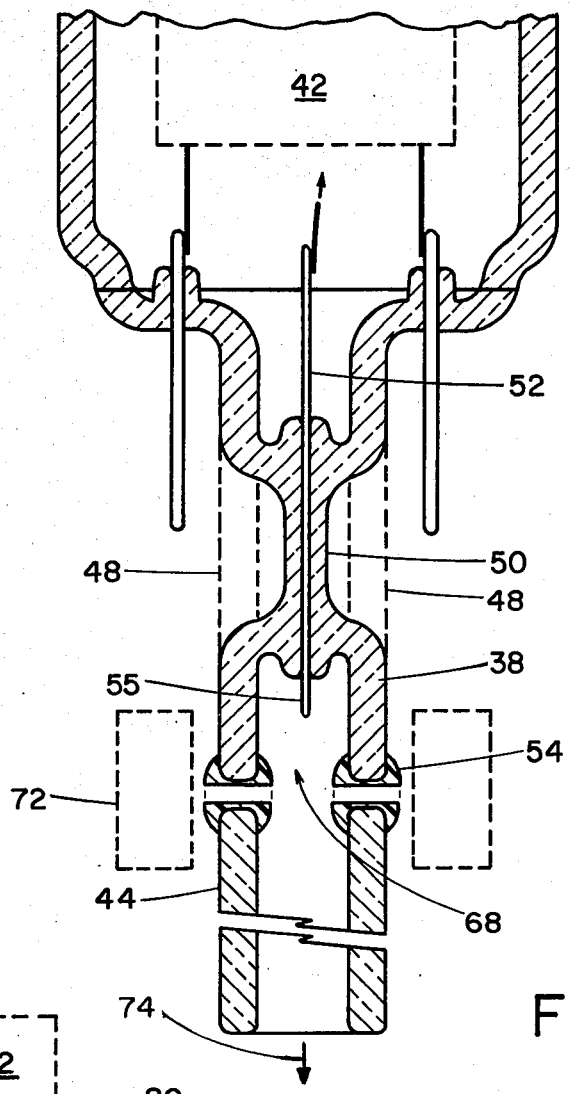
FIG. 3 shows the structures at a later time during the practice of my method.

FIG. 2 shows a base of a television cathode ray tube. The base includes a narrow neck section 34. The preferred method of introducing a high-voltage electrical conductor through the neck of the tube according to this invention will now be described. FIGS. 2 and 3 show by illustration the method in relation to the associated structure.

With reference first to FIG. 2, there is provided a novel gun-base assembly 36. The gun-base assembly 36 comprises a hollow glass stub tubulation 38, on one end of which is an annular glass base 40 carrying an electron gun assembly 42, indicated schematically. A plurality of lead-in pins 46 provides for the introduction of voltages and television signals into the cathode ray tube envelope for the operation of electron gun assembly 42, with interconnection between the lead-in pins and the electron gun assembly shown schematically as being made by leads 48.

The distal end 39 of stub tubulation 38 of gun-base assembly 36 is terminated a short distance (e.g., about one inch) from annular glass base 40. Distal end 39 is preferably flame-rounded to the contour shown, according to standard glass-working practice. The flame-rounding process is valuable in that is relieves stresses in the glass at distal end 39 of stub tubulation 38, and eliminates any chips or cracks that could propagate through stub tubulation 38.

On the distal end 39 of the stub tubulation 38 is secured temporary hollow holder 44, preferably of glass also. The end of temporary holder 44 which abuts distal end 39 of stub tubulation 38 may also have a rounded edge as shown. Temporary holder 44 extends the length of stub tubulation 32 to the conventional four-inch length of the standard exhaust tubulation. Temporary holder 44 is preferably secured to stub tubulation 38 by means of a non-devitrifying frit 54. Frit 44 is preferably compounded to have a low melting point; that is, a melting point of about 450° C. As a result of this low melting point, temporary holder 44 may be detached from stub tubulation 38 without the possiblity of deforming distal end 39 of stub tubulation 38, and without the presence of remnants of the frit on the distal end 39 of stub tubulation 38. The importance of this property will become evident hereafter.

An electrical conductor 52 is provided which passes through stub tubulation 38. In the preferred embodiment of this invention, electrical conductor 52 comprises a conductive wire. This conductive wire may be comprised of an iron core having a copper coating which facilitates a glass-to-metal seal, a sealing technique well known in the art. Also, it is preferable to coat, or "pre-glaze", the copper surface of conductor 52 with low-melting point glass, the purpose of which will be explained. An end 53 of conductor 52 may be connected to an electrode of an electron gun assembly 42. As noted, this could be an electrode of an electron gun requiring a relatively intermediate voltage on at least one electrode in addition to the conventional relatively high ultor anode voltage. Electron guns having extended field lenses may require such a voltage; such guns are described and claimed in U.S. Pat. No. 3,895,253 and 3,995,194, both of which are assigned to the assignee of this invention.

In cathode ray tubes having electron guns not requiring a plurality of high voltages, conductor 52 could as well be connected to the ultor anode to supply the necessary high voltage in lieu of introducing the voltage through the funnel of the cathode ray tube.

Gun-base assembly 36, which carries electron gun assembly 42, is inserted into neck section 34 with the annular glass base 40 making contact with base neck section 34 substantially at junction 56. (See FIG. 3.) Gun-base assembly 36 and neck 34 may then be bonded hermetically at junction points 56 by flame-firing. Alternatively, gun-base assembly 36 and neck 34 could as well be hermetically joined by the use of a high-temperature frit cement.

The envelope of the cathode ray tube is now evacuated through stub tubulation 38 and temporary holder 44. This evacuation is accomplished by inserting the distal end of temporary holder 44 into the vacuum port 58 of vacuum pump 60, shown in highly schematic form. A pliable seal 62, which may be in the form of an O-ring, provides an air-tight connection between the outer walls of temporary holder 44 and vacuum port 58. The evacuation by vacuum pump 60 through stub tubulation 38 and temporary holder 44 is indicated by arrow 64.

When the desired vacuum has been obtained, that is, a vacuum of about $10^{-6}$ torr, tip-off oven 66, indicated in highly schematic form, is positioned as shown in FIG. 2; that is, between the distal end 39 of stub tubulation 38 and annular glass base 40. Tip-off oven 66 may comprise a circumferential resistive element energized by an electric current. The heat circumferentially applied by tip-off oven 66 to stub tubulation 38 causes the glass of stub tubulation 38 to be softened and pulled inwardly by the vacuum within the envelope of the cathode ray tube.

The result of the heating action of tip-off oven 66 as described is shown by FIG. 3, which is an illustration representing a later time during the practice of the method. The original contour of the walls of stub tubulation 38, as indicated by broken lines 48, is altered as shown by the contours of pinch-off 50 which encompasses electrical conductor 52, resulting in a seal between conductor 52 and stub tubulation 38.

As noted in the foregoing, conductor 52 is preferably pre-glazed, with the pre-glazing glass having a lower melting point than the glass comprising stub tubulation 38. Without such pre-glazing, the heat provided by tip-off oven 66 would not be high enough to effect a bond between the metal and the glass. Accordingly, electrical conductor 52 is preferably pre-glazed with a glass having a melting point within the temperature range of tip-off oven 66; that is approximately 1000° C.

Temporary holder 44 is detached from stub tubulation 38 by the method illustrated by FIG. 3 and explained as follows. Separation oven 72, indicated schematically, is positioned to circumferentially enclose the adjoined ends of temporary holder 44 and stub tubulation 38. Separation oven 72, which may be similar in form and function to commercially available tip-off oven 66, applies heat to melt non-devitrifying frit 54, resulting in the detachment of temporary holder 44, as indicated by arrow 74. It will be observed that detaching temporary holder 44 from stub tubulation 38 forms a cup 68 in the end of stub tubulation 38 for receiving an electrical connector. Upon melting, no appreciable residue of frit 54 remains on the end of stub tubulation 38.

To prevent the aforedescribed pre-glazing glass from flowing down over tip 55 of conductor 52 during the pinch-off process, tip 55 is preferably dipped in an antistatic graphitic compound to repel the flow of the preglazing glass. This step insures that the proper electrical contact can be made with tip 55 when an electrical connection is made in cup 68, because stray glass does not form an insulative coating over tip 55. In another embodiment of this invention, the electrical conductor comprises disposing a conductive coating on an inner surface of stub tubulation 38. This conductive coating may, for example, be comprised of a finely particulated compound of vanadium and phosphorous mixed with toluene to form a paint which is applied to the inner surface of stub tubulation 38. To fix the compound, low-temperature bake-out may be necessary. By way of example, the conductive coating may be comprised of 75% $V_2O_5$ and 25% $P_2O_5$. The invention is not limited to this compound; many other conductive materials suitable for this application will suggest themselves to those skilled in the art; for example, the conductive coating could as well be a conductive glass.

Figure 4:
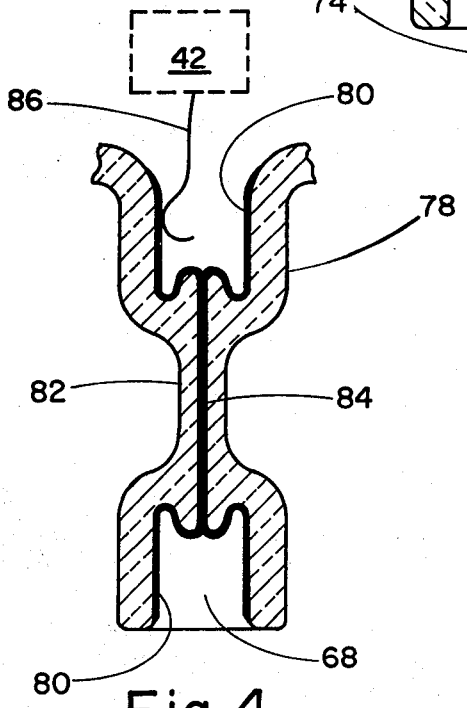
FIG. 4 is a sectional fragmentary side view of a cathode ray tube base representing an alternative embodiment of the invention.

With reference now to FIG. 4, which shows the alternative form of the invention, a section of a stub tubulation after pinch-off will be recognized from the previous description. In this embodiment of the invention, the electrical conductor comprises the disposing of conductive coating 80 on the inner surface of stub tubulation 78 as heretofore described. In this embodiment of the invention, pinch-off 82 is shown as having collapsed conductive coating 80 into a central electrically conductive core 84 which is effective in sealing pinch-off 82 against re-entry of air.

Electrical connection through conductive coating 80 can be made internally by any of several well-known means. In this embodiment, connection is shown schematically as being made by a contact spring 86 in electrical contact with conductive coating 80. Spring 86 in turn may be electrically connected to an electrode of electron gun assembly 42, also shown schematically. Alternatively, the potential obtained through contact spring 86 from conductive coating 80 may as well be routed directly to the ultor anode of the cathode ray tube by suitable conductive means, making possible the elimination of the high-voltage anode button protruding through the funnel of the cathode ray tube.

Figure 5:
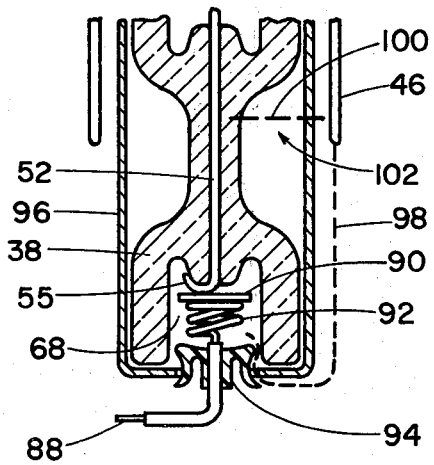
FIG. 5 is a sectional view of the FIG. 3 structure, but with a high voltage electrical connector added.

FIG. 5 depicts in simplified form the receiving of an insulated electrical conductor 88 into cup 68 formed in the end of stub tubulation 38. In this embodiment, electrical conductor 52 is shown as being a conductive wire through stub tubulation 38. Tip 55 of electrical conductor 52 is shown as being bent within cup 68. Spring-loaded metal contact pad 90 is pressed against bent tip 55 by spring 92. Electrical conductor 88 is bonded to spring 92 to form an electrical connection. Entry into cup 68 by electrical conductor 88, and retention of conductor 88 within the cup, is made by means of plug 94, which through pressure of insertion into cap 96, insures a positive electrical connection and a positive insulative seal.

Plug 94, which may comprise a resilient insulative material such as an allylic plastic, effectively covers cup 68 to electrically isolate the connection area. In cases where there is a high potential difference between a lead-in pin 46 and the electrically charged parts within cup 68, the lengthy path between the two cited parts, as indicated by broken line 98, insures adequate isolation and resistance to arcing. Similarly, the straight-line path of a potential arc shown by broken line 100 is interrupted by the high dielectric strength of the glass of stub tubulation 38, the free space 102 between the walls of stub tubulation 38 and cap 96, and the high dielectric strength of the wall of cap 96.

In the embodiment of the invention wherein a conductive coating on the inner surface of the stub tubulation is used, as shown by FIG. 4, the means for receiving a high voltage in cup 68 can be very similar to the means illustrated by FIG. 5. Reference to FIG. 4 will show that conductive coating 80 enters cup 68 in a manner similar to tip 55 shown by FIG. 5. Similarly then, contact pad 90 of the configuration of FIG. 5 can as well be caused to make electrical contact with a conductive coating 80 entering cup 68.

Having described illustrative method and structure implementations of the invention with reference to the accompanying drawings, it is to be understood that the invention is not limited to those precise implementations, and that various changes and modifications may be effected therein by one skilled in the art without departing from the scope or spirit of the invention.

I claim:

1. In the manufacture of a television cathode ray tube which includes an envelope with a narrow neck at one end, a method of introducing a high-voltage electrical conductor through the neck of the tube, comprising:

providing a gun-base assembly comprising a hollow glass stub tubulation on one end of which is an annular glass base carrying an electron gun assembly, and on the distal end of which is temporarily secured a hollow holder;

providing an electrical conductor which passes through said stub tubulation;

inserting said gun-base assembly into said neck of said tube and hermetically bonding said base to said neck;

evacuating said tube through said stub tubulation and said temporary holder;

applying heat circumferentially to said stub tubulation between said distal end of said stub tubulation and said base to soften and pinch off said tubulation, sealing the evacuated tube against re-entry of air; and detaching said temporary holder from said stub tubulation to form a cup in said end of said tubulation for receiving an electrical connector.

2. The method defined by claim 1 wherein said providing of an electrical conductor comprises passing a conductive wire through said stub tubulation.

3. The method defined by claim 1 wherein said providing of an electrical conductor comprises disposing a conductive coating on an axially extending inner surface through said stub tubulation.

4. In the manufacture of a television cathode ray tube which includes an envelope with a narrow neck at one end, a method of introducing a high-voltage electrical conductor through the neck of the tube, comprising:

providing a gun-base assembly comprising a hollow glass stub tubulation on one end of which is an annular glass base carrying an electron gun assembly, and on the distal end of which is temporarily secured a hollow holder, including disposing a conductive coating on an inner surface of said stub tubulation and throughout the length thereof;

inserting said gun-base assembly into said neck of said tube and hermetically bonding said base to said neck;

evacuating said tube through said stub tubulation and said temporary holder;

applying heat circumferentially to said stub tubulation between said distal end of said stub tubulation and said base to soften and pinch off said tubulation, sealing the evacuated cathode ray tube against re-entry of air, said coating forming a continuous conductor extending through said stub tubulation; and detaching said temporary holder from said stub tubulation to form a cup in said end of said tubulation for receiving and electrical connector.

* * * * *